US005251761A

United States Patent [19]

Hansen et al.

[11] Patent Number: 5,251,761

[45] Date of Patent: * Oct. 12, 1993

[54] METHOD OF COLLECTING RECYCLABLE MATERIALS

[75] Inventors: David Hansen, West Sand Lake; Patrick F. Mahoney, Rensselear, both of N.Y.

[73] Assignee: EAC Systems, Inc., Albany, N.Y.

[ * ] Notice: The portion of the term of this patent subsequent to Dec. 17, 2008 has been disclaimed.

[21] Appl. No.: 805,305

[22] Filed: Dec. 10, 1991

Related U.S. Application Data

[63] Continuation-in-part of Ser. No. 350,085, May 10, 1989, Pat. No. 5,072,833.

[51] Int. Cl.[5] ..... B07C 5/02

[52] U.S. Cl. ..... 209/3.3; 100/35; 206/459.5; 209/930; 220/404; 383/102; 383/117; 383/127; 414/786

[58] Field of Search ..... 209/3.3, 10, 12, 583, 209/930, 942; 220/404; 232/43.1, 43.2, 43.5; 248/95, 97, 99, 100, 101, 542, 907; 312/211, 212; 383/102, 117, 127, 103; 206/459.5; 414/786, 515; 100/35, 229 A

[56] References Cited

U.S. PATENT DOCUMENTS

| | | | |
|---|---|---|---|
| 652,331 | 6/1900 | Rudolph . | |
| 1,372,190 | 3/1921 | Randall et al. . | |
| 2,257,567 | 9/1941 | Matanovich-Manov et al. . | |
| 2,911,119 | 11/1959 | Kuhnou | 414/517 |
| 3,557,685 | 12/1968 | Schroering . | |
| 3,595,389 | 3/1970 | Morgan . | |
| 3,925,198 | 12/1975 | Eckhoff et al. . | |
| 4,044,569 | 8/1977 | Harza | 100/229 A |
| 4,058,217 | 11/1977 | Vaughan et al. . | |
| 4,077,847 | 3/1978 | Choi et al. . | |
| 4,109,571 | 8/1978 | Difley et al. . | |
| 4,187,755 | 2/1980 | Flender . | |
| 4,366,949 | 1/1983 | Staub, Sr. . | |
| 4,473,373 | 9/1984 | Weiss . | |
| 4,479,581 | 10/1984 | Kelyman, Jr. . | |
| 4,552,500 | 11/1985 | Ghibaudo et al. | 414/517 |
| 4,555,212 | 11/1985 | Jones . | |
| 4,627,783 | 12/1986 | De Filippi . | |
| 4,660,758 | 4/1987 | Tavel et al. . | |
| 4,680,808 | 7/1987 | Paleschuck . | |
| 4,682,699 | 7/1987 | Ertley . | |
| 4,743,123 | 5/1988 | Legters et al. . | |
| 4,750,639 | 6/1988 | Schaerer . | |
| 4,949,528 | 8/1990 | Palik . | |
| 5,072,833 | 12/1991 | Hansen et al. . | |

FOREIGN PATENT DOCUMENTS

| | | |
|---|---|---|
| 652473 | 11/1962 | Canada . |
| 3636310 | 4/1988 | Fed. Rep. of Germany . |

*Primary Examiner*—H. Grant Skaggs
*Attorney, Agent, or Firm*—Hoffmann & Baron

[57] ABSTRACT

A method of handling recyclable materials through the use of distinctive, and relatively rugged plastic bags is provided. Such bags are furnished to one or more communities as part of a recycling program. The bags preferably include source identification codes particular to each community. The bags are filled with recyclable materials, closed, and left at curb side or other location for pick up by collection equipment. The bags, which may be comingled with other, non-recyclable waste materials, are gathered and compacted in order to reduce the volume thereof. The rugged construction of the bags ensures that a relatively high percentage survive the compaction process without spilling the materials contained therein. Bags are then transported to a delivery point where they are separated from other comingled waste materials. Bags may then be emptied and the materials contained therein recycled.

8 Claims, No Drawings

METHOD OF COLLECTING RECYCLABLE MATERIALS

CROSS REFERENCE TO RELATED APPLICATION

This is a continuation-in-part of Ser. No. 07/350,085 filed May 10, 1989, now U.S. Pat. No. 5,072,833.

FIELD OF INVENTION

The present invention relates generally to methods of collecting and processing recyclable materials.

BACKGROUND OF THE INVENTION

The ever increasing quantities of solid waste generated each day present major collection and disposal problems which have been increasingly well recognized.

Some wastes, such as solid organic waste, can be recovered and reused or converted to energy, whereas other wastes, such as plastics, glass, metal and paper can be recovered and recycled for new uses. Such recovery and recycling frequently involves processing such wastes into high grade commodities at a materials recycling or recovery facility. In general, the materials recovery facility (MRF) is a processing center where recyclables are separated and processed to maximize value and reusability.

Examples of waste recovery operations are described in Choi et al. U.S. Pat. Nos. 4,077,847; Eckoff et al. U.S. Pat. No. 3,925,198 and Kelyman, Jr. U.S. Pat. No. 4,479,581.

Conventional methods of disposal, such as using landfills, are becoming prohibitively expensive and sometimes create serious pollution problems. Recovery and processing of recyclable material is becoming essential to our society's waste reduction and management practices.

The benefits of recycling solid waste material are many. Use of recyclable materials often saves considerable energy and natural resources when compared with production of goods from raw materials. Communities participating in recycling programs may share in the revenues from the sale of the recyclable materials and realize a net reduction in their solid waste disposal costs. By shredding solid organic waste, and removing ferrous metals therefrom using magnetic-based separation technology, processed refuse fuel (PRF) can be produced from solid organic waste and can thereafter be converted into electrical power (e.g. by burning in a PRF fired boiler), and sold to electric companies, thereby providing additional revenues.

It has been reliably estimated that 30–70% of the solid waste stream is recoverable, and that MRF's are capable of reducing the amount of solid waste to be disposed of by as much as 25%.

A number of programs presently being promoted require special collection bins or collection containers and separate translate into high costs and inconvenience to residents.

Some programs as discussed above use separate collection bins, e.g. "Blue Bins" or Boxes, that are set out along curbside on special pickup days, and which are picked up separately from other household and/or commercial solid waste, using specially designed collection vehicles, often supported by additional trucks and trailers to pick up and transfer recyclables. Other such programs involve the use of carrier bags which are transported by trucks to a sorting area. Recyclable materials are sorted by hand or through the use of a bag rupturing apparatus. U.S. Pat. No. 4,555,212 discloses a bag rupturing apparatus which includes a screw impeller.

The collection and transportation of recyclable items is a major factor in the cost of recycling. If such items must be segregated upon collection, the collection process becomes more time consuming and costly. If the items are not compacted, they occupy too much space. Finally, if the recyclable items are so intermingled with unrecyclable materials that sorting becomes difficult at the materials recovery facility, the cost of sorting will significantly and adversely impact the efficiency of the recycling procedure.

Accordingly, there is great need for improved methods of collecting recyclable materials, for subsequent recycling at recyclable material recovery facilities. Therefore, it is the primary object of the present invention to provide a novel alternative to prior art methodologies for collecting recyclable materials, and also, solid waste collection programs based thereon.

SUMMARY OF THE INVENTION

The present invention concerns a method of collecting recyclable materials for recycling and delivering the material to a recyclable material recovery facility. The method comprises placing recyclable material into flexible receptacles or containers having rugged constructions sufficient to withstand forces experienced under compaction, transfer and dumping. Each flexible receptacle preferably has visually detectable means on the exterior thereof, for rendering the flexible receptacle highly visible against and distinguishable from other solid waste in the solid waste stream. Each flexible receptacle may bear source identification means, e.g., source code or indicia, on the exterior of the flexible receptacle. This source indicia could serve to identify the source of the recyclable material placed in the flexible receptacle and to provide instructions as to its correct usage.

A method of collecting and sorting recyclable materials efficiently and relatively inexpensively in accordance with the invention includes the initial step of providing flexible bags to a community. The bags should be of relatively rugged construction The bags are filled with recyclable materials and closed. They are then collected and compacted The compaction process reduces the volume of the bags in such a manner that a high percentage of the bags survive such compaction intact. The compacted bags are then transported to a material recovery facility where they are emptied. The recyclable materials may then be processed so that they may be reused.

The bags employed in the above-described method are preferably distinctive in appearance or other physical characteristics. This allows them to be co-mingled with other solid waste materials without being difficult to sort at the materials recovery facility. The bags may also be coded so that information concerning the origin and/or contents of the bags can be easily determined.

DETAILED DESCRIPTION OF THE INVENTION

The preferred embodiment of the method of collecting recyclable materials will be described as follows.

In order to collect recyclable materials such as cans, plastic cups, glass containers, bottles, jars and paper products such as newspapers, magazines, books and the like, a collection bag is used.

The collection bag must be capable of withstanding the forces experienced under pick-up, compaction, transfer, and dumping operations. It should accordingly be constructed such that it (i) will not tend to tear if it is punctured; and (ii) will not "pop" or burst upon compaction in, for example, a compactor-type refuse collection truck.

In the preferred embodiment, the collection bag is formed from a fully recyclable material such as woven polypropylene or other material providing equivalent physical characteristics. The dimensions of the bag may approximate those of conventional garbage bags or leaf bags. The bag includes a flexible receptacle portion defining a partially enclosed volume and has an opening for insertion of recyclable materials. The collection bag, if sufficiently porous, will tend to avoid bursting upon compaction. During extensive testing and analysis of woven polypropylene bags under actual test conditions, such bags have proven able to withstand forces experienced under compaction, transfer and dumping operations. In fact, bags of woven polypropylene construction have shown in actual testing to have a 95% bag survival rate when used under actual conditions using compactor-type refuse collection trucks.

Other types of materials having other grades of material strength, can be used to construct the collection bags used in accordance with the present invention. However, such recyclable material collection bags should possess the above-described physical characteristics and properties.

In general, the collection bags should be highly visible against and distinguishable from other solid waste. In the preferred embodiment, this visually detectable means is realized as a highly visible predetermined color scheme. In particular, a predetermined color scheme that has been discovered to be highly effective in carrying out the objects of the present invention, is a predetermined color, such as bright orange. However, it is expected that bright green colored bags and bags of fluorescent orange, pink or yellow/green color can also be used with good results as such colored bags are easily spotted at the picking station of a solid waste facility.

In order to identify the source of the recyclable material placed in the recyclable material collection bag, the bag could bear or carry a source identification means or coding system, which can be, for example, a sequence of numbers, a bar code, an arrangement of alpha-numerical characters, or other symbols which serve to identify the source of the recyclable material placed in the flexible bag. If provided, the source identification is marked in a contrasting color upon the bright surface of the flexible bag. However, according to principles of the present invention, the source identification means could alternatively be a source identification means in the form of a flexible adhesive label or sticker "encoded" so as to identify the source, or community, or municipality from which the bag originated. Preferably, in this embodiment, the encoded adhesive label can be firmly adhered to the bag. One advantage of this approach is that the bags in stock can be "source encoded" using the encoded labels corresponding to a particular community, and thereafter distributed (i.e., supplied) thereto, thereby satisfying the requirements of the various communities. "Encoded" tags or tie strings or devices for securely closing the collection bags could alternatively be employed. Here, the tie string could have a distinctive color, tag, or physical attribute (e.g., notches formed therein, or code embossed thereon) which is capable of identifying a particular source or community.

In the preferred embodiment, the source identification means (i.e., source indicia or code) comprises the sequence of repeating characters disposed along the length of the bag. The repeating characters serve to identify the source from which the recyclable material in the bag originates. Alternatively, however, the source indicia can be, for example, a bar code. One advantage of this type of code is that it could be read using, for example, automatic character recognition apparatus known in the art.

In the preferred embodiment, each recyclable material collection bag bears on its external surface, instructional indicia, which can be, for example, written instructions as to how to use the bag within a particular recyclable material collection program being implemented within a particular community. Also the instructions indicate the types of recyclable materials which can be placed inside the recyclable material collection bag, as well as indicate those materials which should not be placed within the bag. Thus by indicating on the collection bag "the do's and don'ts" to consumers participating in the recyclable material collection program, the likelihood of success of the program is substantially increased.

The method of the present invention will now be described in detail.

The above-described collection bags are manufactured in mass supplies and then distributed by a licensed recyclable material bag supplier or suppliers. To carry out the method of the present invention, there are several ways in which the bags may be distributed. For example, the bags may be distributed by the community participating in a particular recyclable material collection program. The persons who actually distribute them might be, for example, municipal workers. On the other hand, the bags can be distributed by being offered for sale in retail outlets or otherwise purchased by consumers. The manner in which the bags are distributed however, depends on the structure of the particular recyclable material collection program.

In the preferred embodiment of the method of the present invention, recyclable material is placed within the collection bags. Closure devices are used to securely close the openings of the receptacle portions of the bags, so that the closed bags can withstand forces experienced under compaction, transfer, and dumping operations without breakage and consequent spillage of the solid recyclable waste contained therein. The closure devices may be sealing devices having ratchet-like tightening mechanisms, as known in the art. Other closure systems, for example, (i) a tie string, (ii) a string attached to the collection bag, (iii) a nylon-wire tie, separate from the collection bag, or (iv) a draw-string woven into the collection bag, can be used with acceptable results. However, since a closure device is required for each collection bag distributed within any particular collection program, cost factors of the closure device should be considered as well.

Once the collection bags are filled with recyclable materials and securely closed using a closure device, the bags are deposited at curbside along with other household, commercial or other solid waste which is to be picked up by a collection truck participating in a curbside waste collection system. The bags are then picked up along with other household, commercial or other solid waste, and placed in a collection truck. The collection truck preferably compacts the bags with other household trash as required, and eventually transfers the compacted bags and other solid household waste to the tipping floor of a solid waste facility. The collected waste in the truck is then dumped onto a tipping floor and eventually placed or pushed onto a conveyor of a picking station.

At the picking station, the recyclable material collection bags are easily identified by their bright orange color and/or identifying logo (i.e. visually detectable means), and are removed from the stream of solid trash moving along the conveyor.

To carry out such a "picking operation," the solid waste or functionally equivalent facility must be provided with the capability of efficiently separating out the collection bags from other trash moving along the solid waste stream. There are a variety of ways in which to perform this function.

The bag "picking" or removal operation may be carried out by workmen manually picking out the highly-visible recyclable material collection bags from other solid household and commercial waste moving along a "pit" conveyor at the picking station. To carry out this manual operation, workmen can utilize a specially developed "picking instrument". This instrument comprises a light-weight shaft (preferably made from aluminum or carbon fiber), and a picking means. The shaft is adapted to be held in a person's hand much like a rake, and includes a plurality of claw-like projections with slightly turned-in end projections. The picking instrument also includes a planar, spade-like structure disposed opposite from the claws. The slightly turned-in projections can be selectively inserted into the interstices of the warp and weft of the woven plastic construction of the flexible bags to facilitate retention. By slight inward and upward motion of the claws, the bag is easily freed from the picking means. Also, in order to move or push other solid trash away from a visually recognized bag hereof, that is, without retaining or grabbing a flexible bag hereof, the planar structure is employed as a solid waste moving means.

In order to increase the recovery rate of bags from the solid waste stream moving along the pit conveyor, an auxiliary picking station may be employed. This auxiliary picking station includes an inclined conveyor which moves solid waste to the infeed chute of a solid waste shredder. The auxiliary picking station also includes a manned platform located over or alongside the inclined conveyor. It has been discovered that even when load depth on the infeed conveyor is high, the auxiliary picking station provides improved recognition of bags by workmen, and thus improved bag recovery while utilizing the picking instrument described above.

Alternatively, the operation of picking out filled collection bags from the solid waste stream can be carried out using automated means. Such automated means for picking-out bags hereof may include one or more robotic arms, each having "claws" or grabbing means which, in many respects, are functionally equivalent to the ones on the manually-operated picking instrument. Such grabbing means serve to pick up, hold and release the flexible bag in response to bag-hold and bag-release signals, respectively. The automated bag picking means would be installed adjacent a conveyor system, along which a solid waste stream with filled bags intermixed therein passes. A computer control system may be provided to control the movements of the robotic arms in response to sensed imagery of the solid waste stream generated by a machine vision system. In particular, the machine vision system would recognize the visually detectable means (e.g. the highly visible color and/or distinctive marking) on the exterior of each recyclable material collection bag in the solid waste stream. In response to such visual "bag" detection, the machine vision system generates on a real-time basis, bag-position signals, which for example, would correspond to a bag's position (i.e. X, Y, Z coordinates) along the conveyor at some instant of time, $t_i$. The bag-position signals are provided to the computer-control system, and in response thereto, the computer-control system computes command instructions guiding the robotic arm to pick out a "recognized" bag and place it, for example, onto another conveyor system designated for the transfer of collection bags to a selected area. The release of the bag from the grabbing means is effected in response to presentation of bag-release signals from the computer control system. Once removed, the bags may then be transferred to a measuring and recording station.

At the measuring and recording (i.e. accounting) station, the weight of each bag is individually measured and recorded. The source identification code on the exterior of each bag is read or otherwise recognized, in order to identify the source, i.e. community, of the recyclable material placed in the bag. On the basis of the read source identification code and recorded weight, each identified community is accredited with the measured weight of recyclable material placed in the recyclable material collection bags. The accounting of such waste material may be carried out using a computer-based information storage and retrieval system well known in the art.

The recyclable material in each bag is then emptied and subsequently processed at the recyclable material recovery facility in a manner known in the art. The emptied recyclable collection bags are then collected and are thereafter recycled.

While the particular embodiments shown and described above have been proven to be useful in many applications involving the recyclable material collection arts, further modifications of the present invention herein disclosed will occur to those skilled in the art to which the present invention pertains and all such modifications are deemed to be within the scope and spirit of the present invention defined by the following claims.

What is claimed is:

1. A method of handling recyclable materials, comprising:

providing flexible bags to a community for filling with recyclable materials and subsequent closure of said bags;

collecting said bags within a compactor-type collection vehicle at a plurality of sites once said bags have been filled with substantially exclusively recyclable materials and then closed;

compacting said bags within said vehicles such that a high percentage of said bags survive the compaction without spilling the recyclable materials contained therein;

transporting said compacted, filled bags within said vehicle to a delivery point; and emptying said bags.

2. A method as described in claim 1, including the steps of gathering said bags with other waster materials not contained within said bags, compacting said bags with said other waste materials, transporting said compacted, filed bags commingled with said other waster materials to said delivery point, and separating said compacted, filled bags from said other waste materials prior to emptying said bags.

3. A method as described in claim 2 including the step of providing flexible bags having identification codes to the community, and detecting said identification codes prior to emptying said bags.

4. A method as described in claim 3 wherein the step of compacting said bags allows about ninety-five percent of said bags to survive compaction.

5. A method as described in claim 1 wherein the step of compacting said bags allows about ninety-five percent of said bags to survive compaction.

6. A method as described in claim 1 including the step of providing flexible bags having identification codes to the community, and detecting said identification codes prior to emptying said bags.

7. A method as described in claim 1 including the steps of providing said flexible bags to a plurality of communities, causing the bags provided to each community to have distinct identification codes, and detecting said identification codes prior to emptying said bags.

8. A method as described in claim 7 including the steps of gathering said bags with other waste materials, compacting said bags with said other waste materials, transporting said bags comingled with said other waste materials to said delivery point, and separating said bags from said other waste materials.

* * * * *